US010738545B2

(12) United States Patent
Clarke et al.

(10) Patent No.: US 10,738,545 B2
(45) Date of Patent: Aug. 11, 2020

(54) PIPE HANDLER AND PIPE LOADER FOR A WELL RIG

(71) Applicant: PROSTAR MANUFACTURING INC., Okotoks, Alberta (CA)

(72) Inventors: Jason Peter Clarke, Calgary (CA); Douglas Andrew Hunter, Calgary (CA); Daniel Harvard Kusler, Foothills (CA); Mark Charles Taggart, Okotoks (CA)

(73) Assignee: Prostar Energy Technologies (USA) LLC, Leduc (CA)

( * ) Notice: Subject to any disclaimer, the term of this patent is extended or adjusted under 35 U.S.C. 154(b) by 0 days.

(21) Appl. No.: 16/062,569

(22) PCT Filed: Dec. 14, 2016

(86) PCT No.: PCT/CA2016/051476

§ 371 (c)(1),
(2) Date: Jun. 14, 2018

(87) PCT Pub. No.: WO2017/100921

PCT Pub. Date: Jun. 22, 2017

(65) Prior Publication Data

US 2019/0003271 A1 Jan. 3, 2019

Related U.S. Application Data

(60) Provisional application No. 62/267,605, filed on Dec. 15, 2015.

(51) Int. Cl.
*E21B 19/15* (2006.01)
*E21B 15/00* (2006.01)

(52) U.S. Cl.
CPC ..... *E21B 19/155* (2013.01); *E21B 15/00* (2013.01)

(58) Field of Classification Search
CPC ..... E21B 19/155; E21B 15/00; E21B 15/03; E21B 15/04; E21B 19/14
USPC ..... 414/22.51–22.71
See application file for complete search history.

(56) References Cited

U.S. PATENT DOCUMENTS 3,561,616 A * 2/1971 Eddy ..... E21B 15/04 414/22.53
3,805,902 A * 4/1974 Storm ..... E21B 15/04 175/85
4,371,041 A 2/1983 Becker et al.
4,494,899 A * 1/1985 Hoang ..... E21B 19/155 414/22.61

(Continued)

FOREIGN PATENT DOCUMENTS

CA 2508998 A1 12/2006

OTHER PUBLICATIONS

International Search Report & Written Opinion for PCT/CA2016/051476 dated Mar. 6, 2017.

(Continued)

*Primary Examiner* — Lynn E Schwenning
(74) *Attorney, Agent, or Firm* — Arent Fox LLP

(57) ABSTRACT

For wellbore operations, a pipe handler moves pipe up to a rig floor. A pipe loader moves pipe from a presented position into alignment with well center. The pipe handler moves pipe up to a slanted presented position. The slanted presented position can be adjusted by manipulating the drive system.

12 Claims, 14 Drawing Sheets

(56) References Cited

U.S. PATENT DOCUMENTS

| | | | | |
|---|---|---|---|---|
| 5,127,790 | A * | 7/1992 | Teague | E21B 19/155 414/22.51 |
| 2005/0269133 | A1 | 12/2005 | Little | |
| 2006/0104746 | A1 | 5/2006 | Thompson | |
| 2009/0279987 | A1 | 11/2009 | Jantzen | |
| 2010/0329823 | A1* | 12/2010 | Baumler | E21B 19/165 414/22.55 |
| 2011/0070054 | A1* | 3/2011 | Crossley | E21B 19/14 414/22.61 |
| 2013/0251491 | A1* | 9/2013 | Ludwig | E21B 19/14 414/745.8 |
| 2013/0343836 | A1* | 12/2013 | Flusche | B23P 11/00 414/22.55 |
| 2014/0119855 | A1* | 5/2014 | Hilton | E21B 19/15 414/22.51 |
| 2015/0136420 | A1 | 5/2015 | Tengliden et al. | |
| 2015/0184472 | A1 | 7/2015 | Miranda et al. | |
| 2015/0259984 | A1 | 9/2015 | Taggart et al. | |
| 2015/0275596 | A1 | 10/2015 | Hickie | |

OTHER PUBLICATIONS

Foremost Industries, "Pipe Handling Systems" brochure, http://foremost.ca/foremost-mobile-eguipment/pipe-handling, Copyright 2015.

* cited by examiner

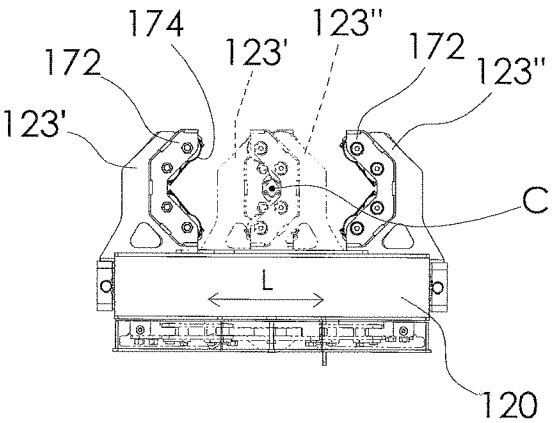
FIGURE 10A
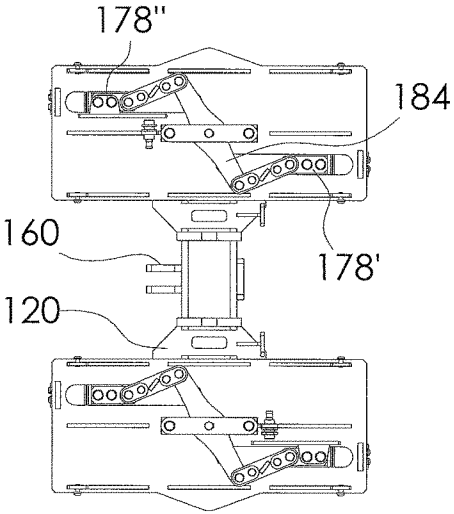
FIGURE 10B
FIGURE 9A
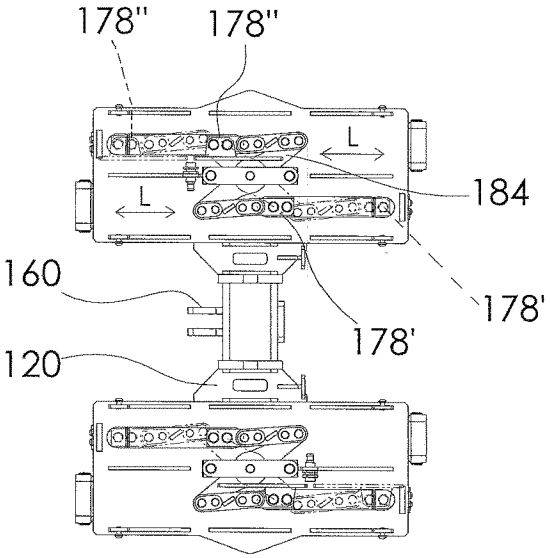
FIGURE 9B

PIPE HANDLER AND PIPE LOADER FOR A WELL RIG

PRIORITY CLAIM

This application claims priority to U.S. 62/267,605, filed Dec. 15, 2015.

FIELD

The invention relates to a pipe loading and handling apparatus for a well rig, including a slant rig.

BACKGROUND

In the drilling and servicing of oil and gas wells, it is known to employ various types of pipes. Such pipes include drill pipe, drill collars, production tubing, well casing/liners and riser pipe. While not strictly considered pipe, some solid elongate members such as sucker rod are also handled and will be considered as pipe herein.

The pipes are manipulated by a well rig to either drill a well or service an already drilled well. The well rigs are sometimes called drilling rigs or servicing rigs but will be called generally a well rig or a rig herein.

Such pipes are delivered to the rig, and laid in individual joints horizontally upon a pipe rack. In the case of land wells, the pipe is typically delivered by a flat-bed truck. For offshore wellsite operations, the pipe is delivered by barge or on a large floating vessel.

In order to use the pipe on the rig, it is necessary to pick up the pipe, which is to transport the pipe from the pipe rack to the rig floor and then manipulate it into alignment with well center such that it can be moved into the well. When the rig is operating to remove pipe from the well, the rig operates to "lay down" the pipe. Sometimes pipe is maintained on the rig floor standing up. If this occurs, the pipes are still manipulated into or out of alignment with well center.

Manipulating pipes up and down relative to the rig and into or out of alignment with well center presents certain hazards to personnel on the rig floor. The rig floor can vary considerably in height.

These concerns are further complicated by the use of slant rigs, where the pipe must be presented in alignment with a well center that is not vertical. While a vertical rig can rely on gravity to move a pipe into alignment with well center, this is not true in a slant rig.

In addition, the actual slant angle at which a slant rig works can vary.

SUMMARY

In accordance with a broad aspect of the invention, there is provided, a pipe handling machine for manipulating joints of pipe at a rig site, the pipe handling machine comprising: a base frame; a trough for accommodating a pipe to be handled, the trough having a first end and a second end; a main pivot link pivotally connected between the base frame and a pivot point adjacent the first end of the trough; a rear link pivotally connected between the base frame and a pivotal connection on the trough, the pivotal connection spaced from the first end; and a linear actuator for driving the trough upwardly to be supported above the base frame on the main pivot link and the rear link, the rear link having a length longer than the main pivot link such that trough is sloped with the first end lower than the second end.

In another aspect, there is also provided a pipe loader comprising: a support beam defining a center axis; a bracket for mounting the support beam to a rig mast; a first arm extending from the support beam; a second arm extending from the support beam, the second arm spaced from and substantially parallel to the first arm; a pipe grabbing head on each of the first arm and the second arm, the pipe grabbing head including pipe holding jaws, a driver to drive the first arm and the second arm in substantial unison about the center axis.

It is to be understood that other aspects of the present invention will become readily apparent to those skilled in the art from the following detailed description, wherein various embodiments of the invention are shown and described by way of illustration. As will be realized, the invention is capable for other and different embodiments and its several details are capable of modification in various other respects, all without departing from the spirit and scope of the present invention. Accordingly, the drawings and detailed description are to be regarded as illustrative in nature and not as restrictive.

BRIEF DESCRIPTION OF THE DRAWINGS

A further, detailed, description of the invention, briefly described above, will follow by reference to the following drawings of specific embodiments of the invention. These drawings depict only typical embodiments of the invention and are therefore not to be considered limiting of its scope. In the drawings:

FIGS. 9A and 9B are end and rear plan views, respectively, of a pipe grabbing head with the jaws open and closed; and FIGS. 10A and 10B are end and rear plan views, respectively, of a pipe grabbing head with the jaws holding a pipe.

DESCRIPTION OF VARIOUS EMBODIMENTS

The detailed description set forth below in connection with the appended drawings is intended as a description of various embodiments of the present invention and is not intended to represent the only embodiments contemplated by the inventor. The detailed description includes specific details for providing a comprehensive understanding of the present invention. However, it will be apparent to those skilled in the art that the present invention may be practiced without these specific details.

The pipe-handling machine generally comprises a pipe trough, a trough-lifting mechanism and a base frame. The trough is carried upward towards a rig floor. The base frame may be positioned adjacent the pipe rack. In one aspect, the trough is folded down onto the base frame for ease of transport and in the first step of a pipe lifting method.

To lift a pipe, the pipe is received onto the pipe-handling apparatus. More specifically, the pipe is received onto the trough. The trough defines an elongated structure having an elongate concave indentation in its upper surface configured to receive a joint of pipe and retain it in the indentation. The trough need not have a solid upper surface.

The trough may be nested into the base frame. To accomplish this nesting arrangement, the upper surface of the base frame is configured to receive the trough on a surface, termed herein the bed.

The trough-lifting mechanism may include a main pivot link pivotally connected between the base frame and a pivot point adjacent the first end of the trough; a rear link pivotally connected between the base frame and a pivotal connection on the trough, the pivotal connection spaced from the first end; and a linear actuator for driving the trough upwardly to be supported above the base frame on the main pivot link and the rear link, the rear link having a length longer than the main pivot link such that trough is sloped with the first end lower than the second end.

The linear actuator provides the drive to lift the trough. The linear actuator may be any linear driver such as a screw drive or a telescoping member such as a cylinder. For example, in one embodiment, the linear actuator is a hydraulic cylinder, as shown.

The first or front end of the trough is pivotally connected to the main link. The cylinder can be actuated to move the front end of the trough upwardly and forwardly on the main link. As the front end of the trough is moved forwardly and upwardly, the rear or second end of the trough is pivoted upwardly and forwardly by the rear link until the trough is supported above the base frame on the links.

The rear portion of the trough is pivotally connected to the rear link. The pivotal connection need not be positioned exactly at the second or rear end, but need only be positioned rearwardly of the pivot point.

Figure 2B:
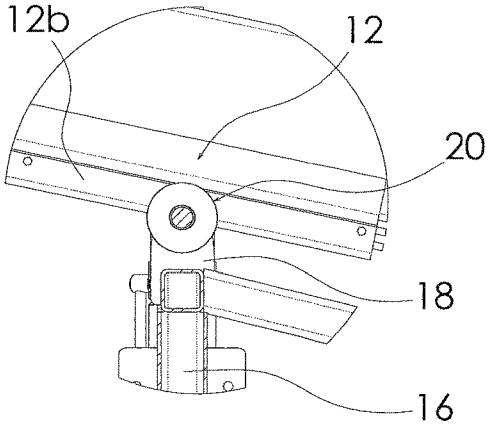
FIGS. 2B and 2C are enlarged views of Details B and C of FIG. 2A.
Figure 2C:
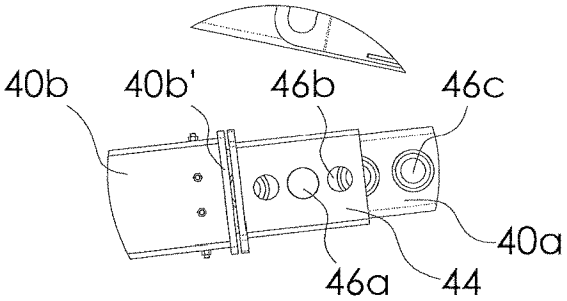
Figure 2A:
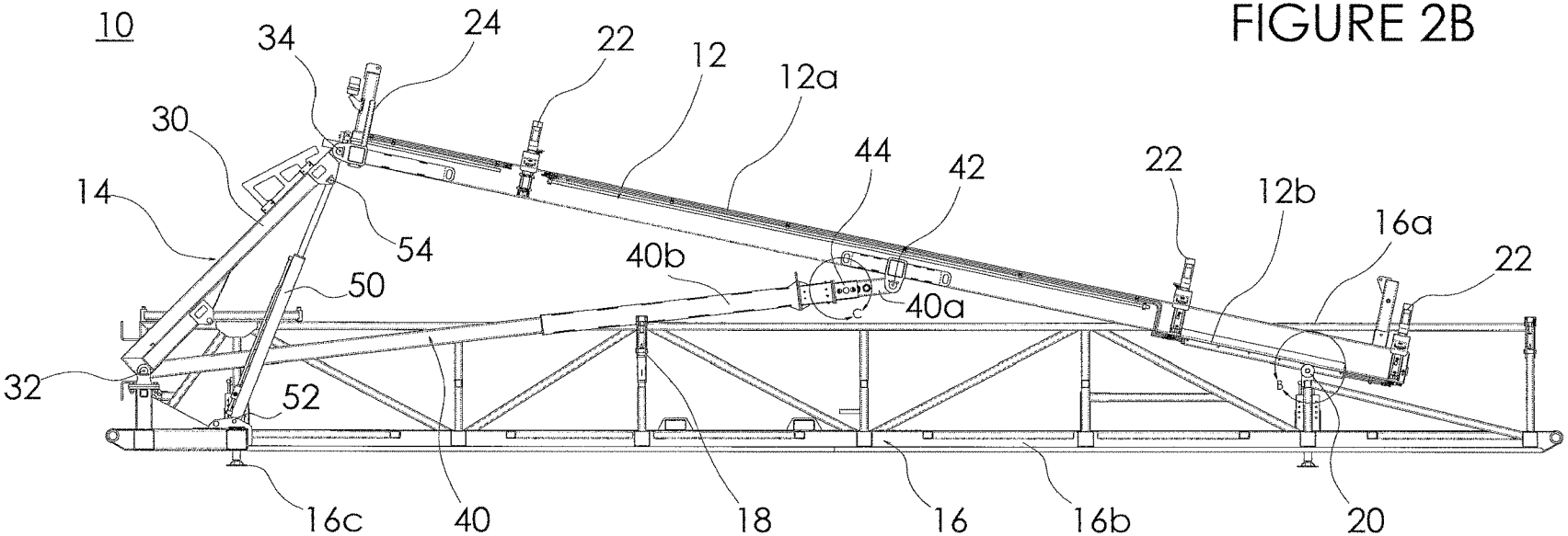
FIG. 2A is a side elevation of the pipe handling apparatus of FIG. 1A at a transition point during lifting. A portion of the upper surface and near side structure of the base frame is removed to facilitate illustration.

As the front end moves forward and upward, in one aspect, the trough is first pulled along the base frame. As the front end moves forward and upward, in one aspect, the back end of the trough rides along the bed of base frame. The bed provides lateral support and facilitates the back end movement. The rear link permits the forward movement before bottoming out at its compressed length and then further pivoting around the rear link begins to pivot the trough upwardly. FIG. 2A illustrates this transition point where the rear link has compressed fully to its compressed length (i.e. the rear link has telescoped down and bottomed out) and trough lifts off the bed of the base frame. In one embodiment, the rear link has a varying length, for example is telescopically extensible and during pivoting by the cylinder, rear link only acts to begin lifting the trough when the rear link is compressed to its lower limit. As such, when the cylinder lifts the front end of the trough to pivot around main link, the rear end of the trough is initially pulled along the base frame. At the same time, rear link collapses telescopically until it bottoms out, for example, it reaches its lower limit and it can telescopically collapse no more. At that point, the rear portion of the trough begins to pivot and to be raised off the base frame. The operation is reversed when laying down pipe.

The apparatus may include one or more pipe clamps on the trough's upper surface. A pipe stop wall is positioned at the front end.

With reference to the Figures, one embodiment of the pipe-handling machine 10 is shown. Machine 10 generally comprises a pipe trough 12, a trough-lifting mechanism 14 and a base frame 16.

The base frame may be positioned between a pipe rack and the rig. The machine operates to handle pipe between the pipe rack and the rig. In particular, the machine in one operation can receive a pipe from the pipe rack, retain the pipe in the trough and lift the trough up to the height of the rig floor, so the pipe can be moved from the trough to well center. In the reverse operation, the machine receives a pipe from the rig onto the trough and lowers the trough down to a height substantially level with pipe rack, so the pipe can be moved from the trough to pipe rack.

When the trough is raised to release a pipe to or accept a pipe from the rig floor, the trough is positioned at a slant angle substantially the same as the rig. When angled, the troughs front end is lower than its rear end. Thus, any pipe on the trough is also and already at the slant angle appropriate for moving directly into alignment with well center.

Figure 1A:
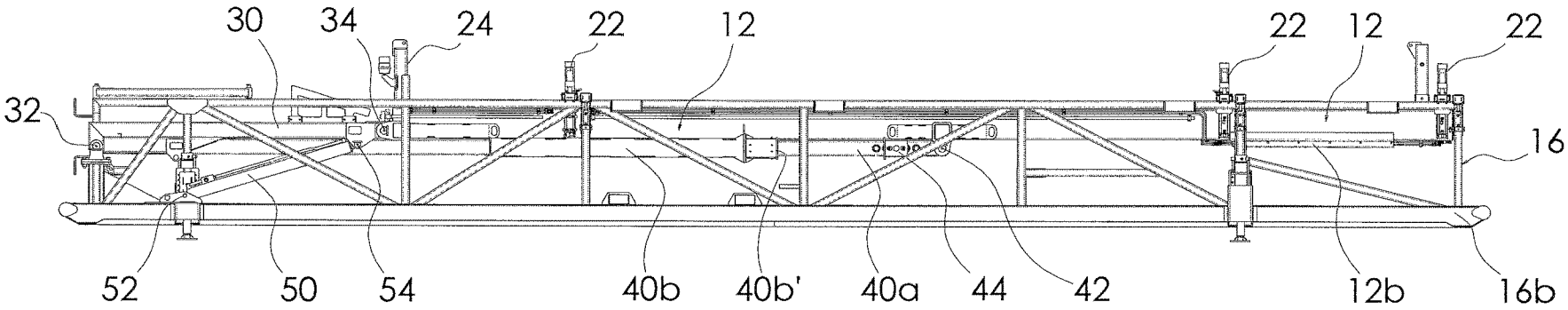
FIGS. 1A, 1B and 1C are side elevation and top, front perspective views, respectively of a pipe handling apparatus folded down, ready to receive a pipe.
Figure 1B:
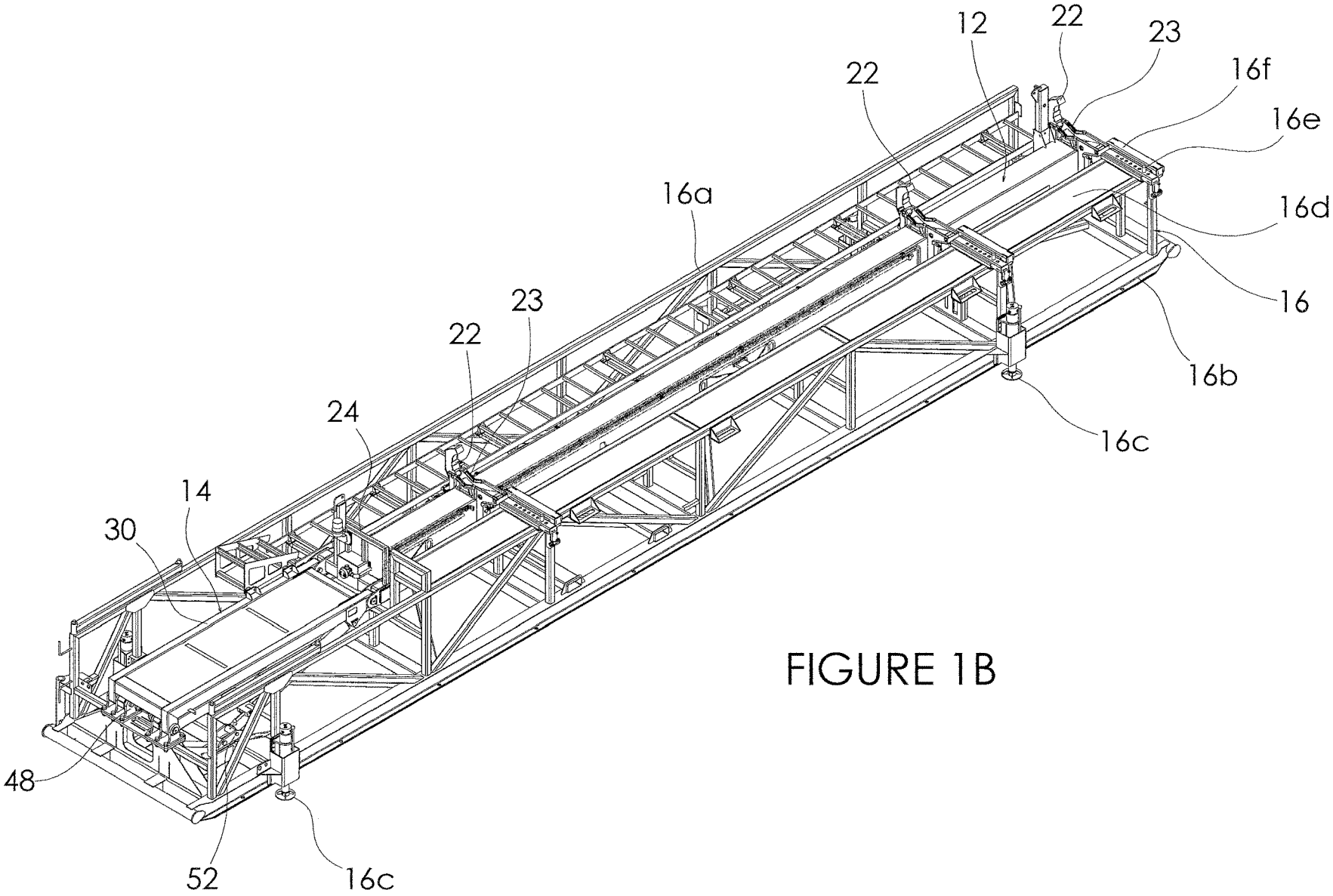
Figure 1C:
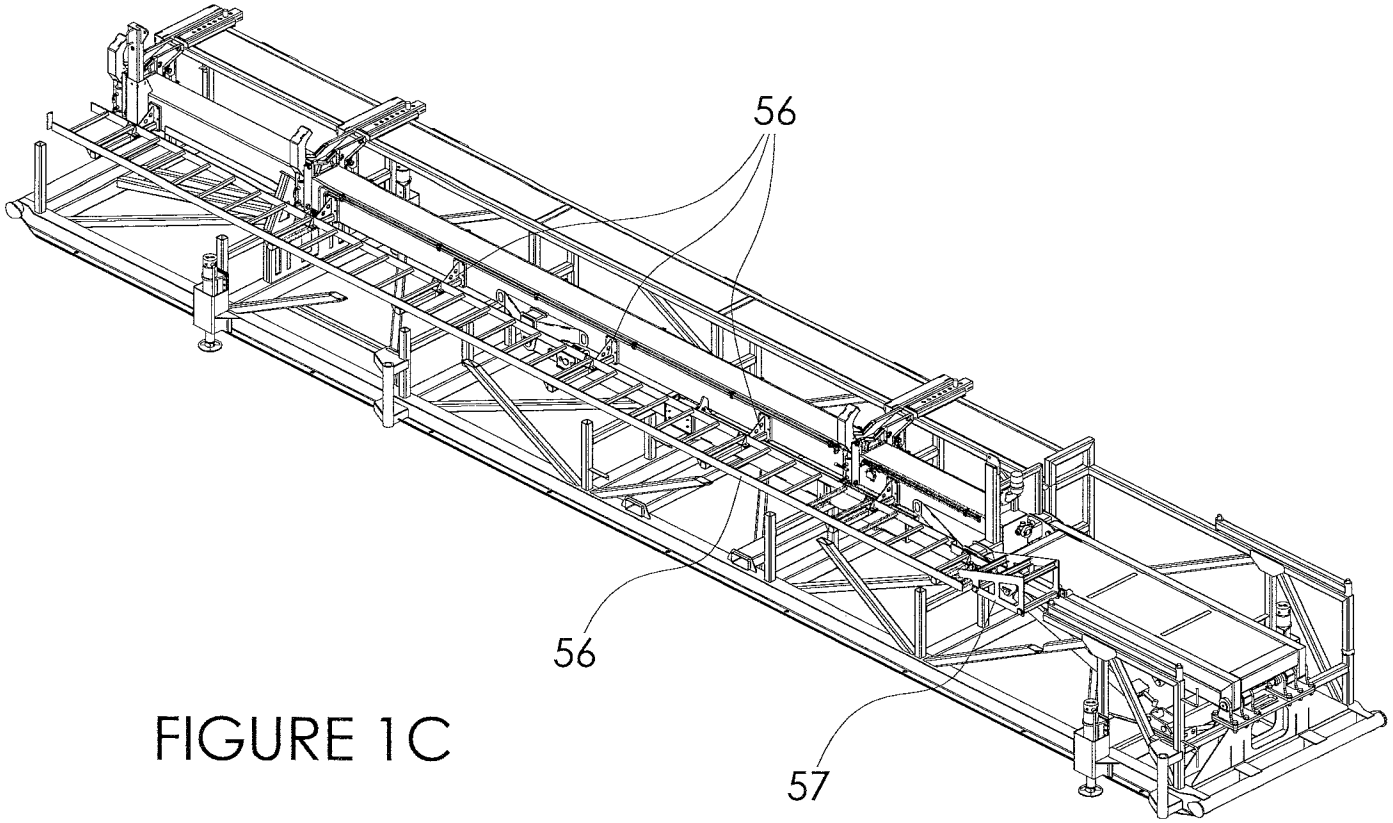
Figure 3A:
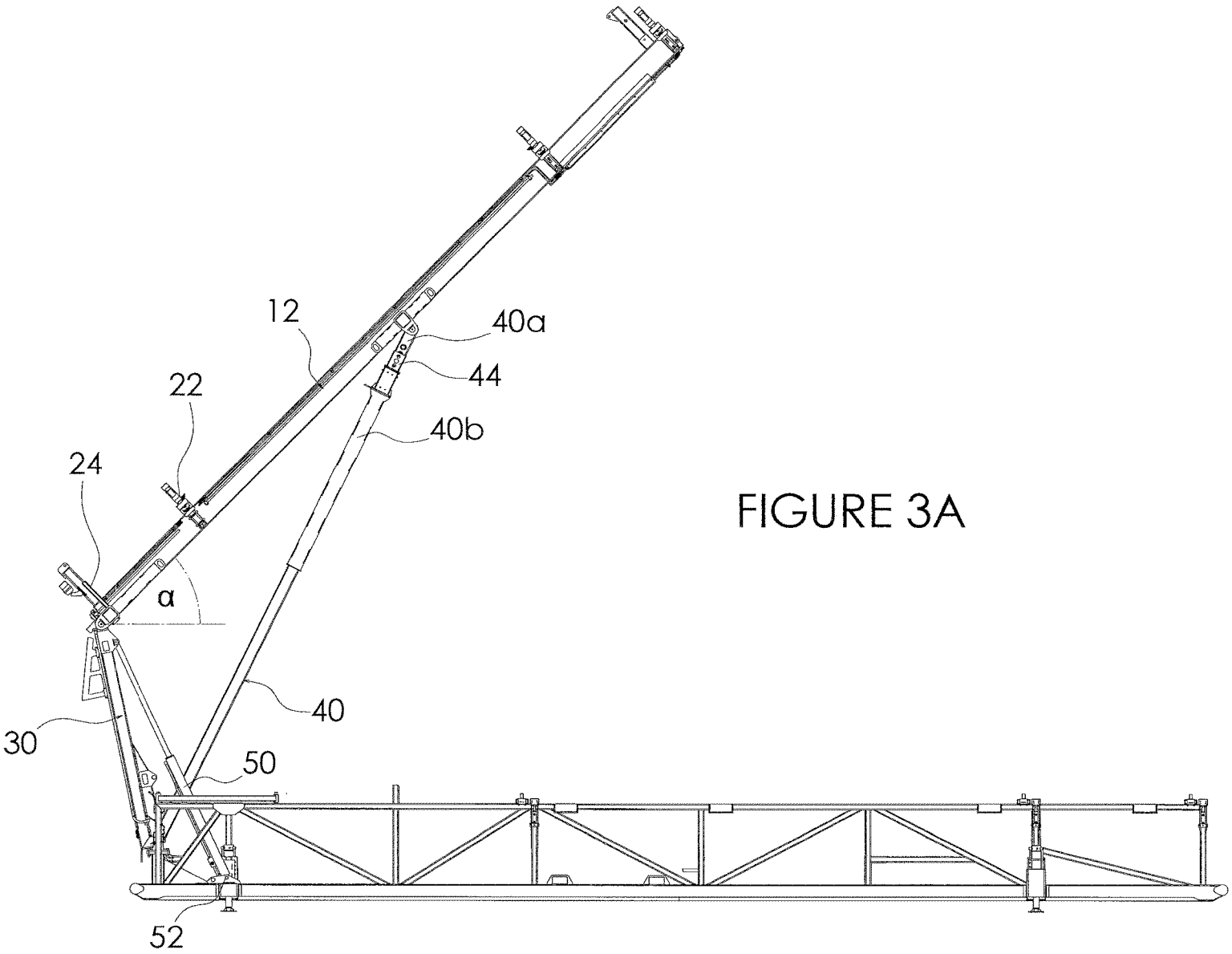
FIGS. 3A, 3B and 3C are side elevation and top, front perspective views, respectively of the pipe handling apparatus of FIG. 1A fully elevated, ready to deliver pipe.
Figure 3B:
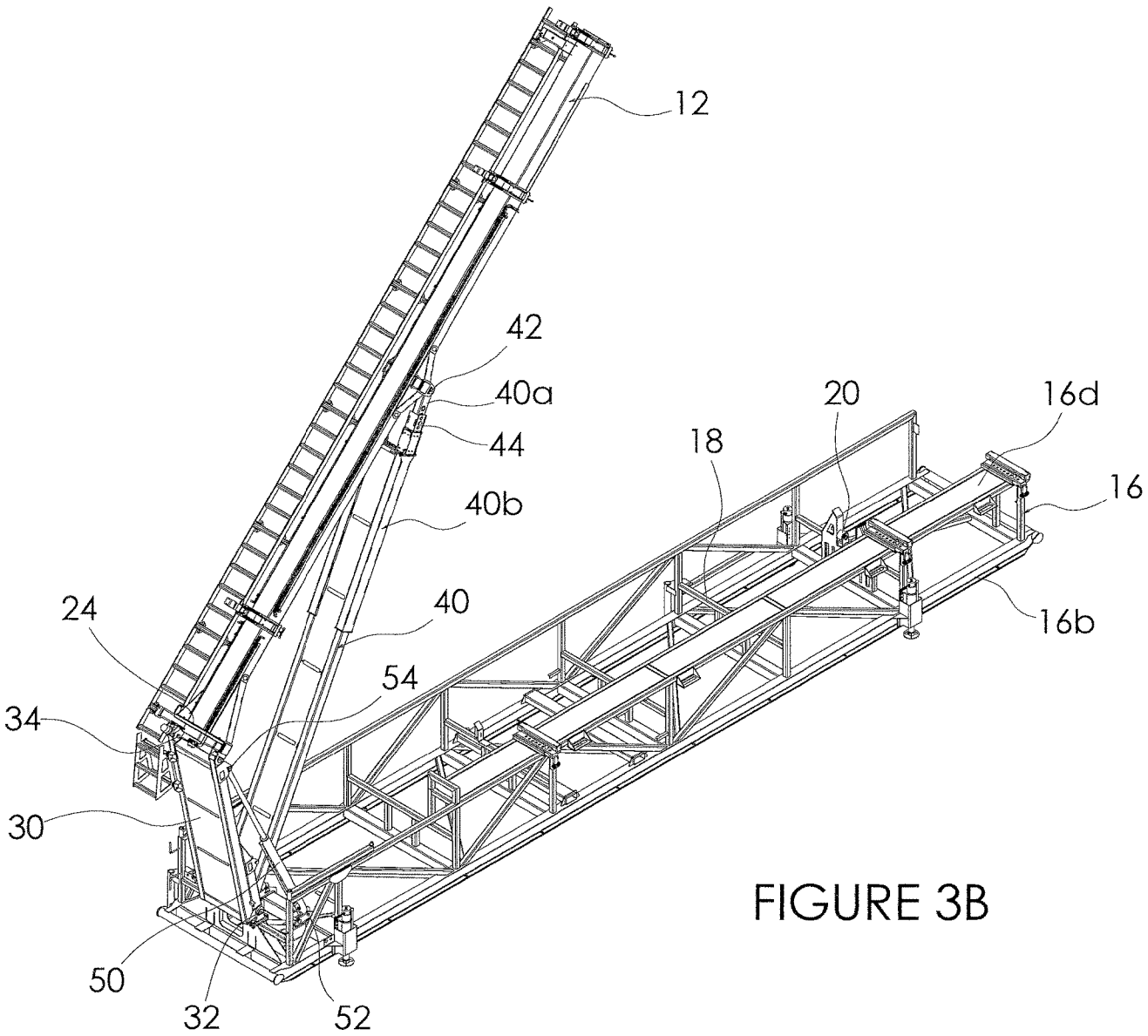
Figure 3C:
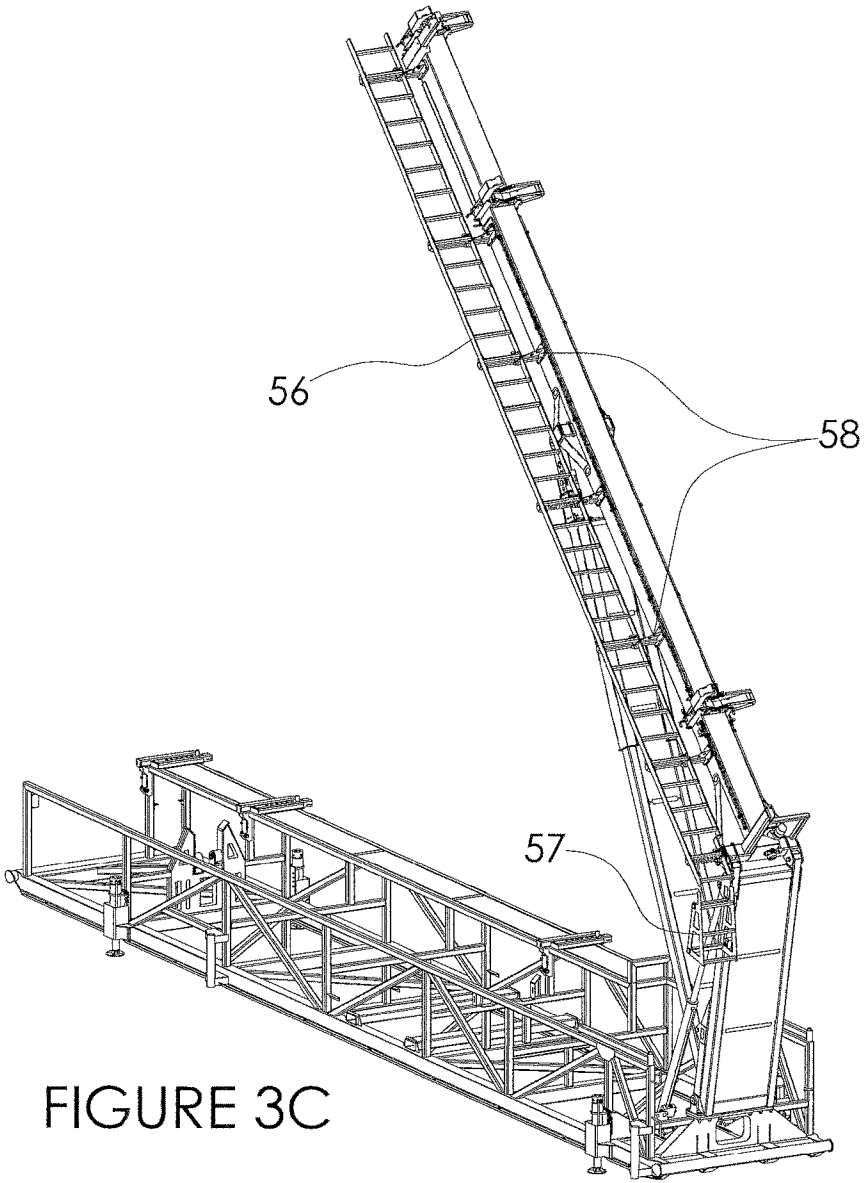

In one aspect, the trough is folded down onto the base frame for ease of transport (FIGS. 1A and 1B) and in the first step of a pipe lifting method and the last step of a pipe lowering method. The trough is moved between its folded position and the rig floor (FIG. 2). The machine holds the trough in a fully elevated position (FIGS. 3A and 3B).

Base frame 16 is configured to support the apparatus on a ground surface and includes support feet, etc. In the illustrated embodiment, base frame 16 includes an upper surface 16*a*, a skid type sub structure 16*b* for ease of transport and leveling jacks 16*c*. Upper surface 16*a* includes a cat walk surface 16*d* over which pipes are moved, as by rolling to enter or exit trough 12. The cat walk surface 16*d* may include pipe indexing mechanism that (i) moves one pipe at a time from a pipe rack (not shown) positionable adjacent the cat walk surface and (ii) controls the position of the pipe so that it moves into trough in a position parallel with the elongate axis of the trough. The indexing mechanism may, for example, include an indexing stop pin 16*e* and an indexing lifter bar 16*f* that lifts a pipe over the stop pin 16*e*.

Trough 12 defines an elongated structure having a concave upper surface 12*a* configured to receive a joint of pipe (not shown). In the folded position, upper surface 12*a* may be substantially co-planar with upper surface 16*a* of the trough. The trough may be substantially nested into the base frame and may rest on a bed 18 recessed into the upper surface of base frame 16.

Bed 18 is defined by one or more supports on which the trough rests. The bed supports may be may include rollers 20, which facilitate axial sliding motion of the trough along the bed. The trough may include runners 12*b* on its underside where the trough bears on rollers 20.

Trough 12 may include one or more pipe clamps 22 to hold a pipe on upper surface 12*a*. There may be pipe gripping surfaces 23 such as teeth on the upper surface to cooperate with clamps 22 to firmly grip the pipe on trough 12. A stop wall 24 may be provided on the front end of the trough to provide extra safety against the pipe sliding off the trough, especially considering that the trough is slanted when it is erected.

The trough-lifting mechanism may include a main pivot link 30 pivotally connected between a hinge 32 on the base frame and a pivot point 34 adjacent the front end of the trough; a rear link 40 pivotally connected between the base frame and a pivotal connection 42 on the trough; and a cylinder 50, such as a hydraulic cylinder, for driving the trough upwardly to be supported above the base frame on the main pivot link and the rear link.

The rear link supports the rear portion of the trough while the main pivot link supports from the front end of the trough. The links are each rigid. Pivotal connection 42 is spaced from the front end and, for example, is positioned between pivotal point 34 and the trough's rear end. While pivotal connection 42 may be positioned directly at the rear end, it may be in an intermediate position. The rear link has a length longer than the main pivot link such that trough 12, when raised is sloped with its front end lower than its rear end.

Main pivot link 30, being secured between the base frame and the trough, permits pivoting movement of the trough. The length of link 30 determines how high the front end of the trough will be above base frame 16, when the trough is fully raised. In the illustrated embodiment, when folded, main pivot link 30 lies along base frame 16 ahead of the front end of trough 12.

Rear link 40, being secured between the base frame and the trough, permits pivoting movement of the trough. In the illustrated embodiment, rear link 40 is a telescopically moveable compression link. Rear link 40 includes a compression bar 40*a* that is telescopically slidable within tube 40*b*. A stop is provided to limit the degree to which the bar can be compressed into tube 40*b*, to thereby determine the final elevated length of the link and, thereby, the slant angle α at which trough will be positioned when raised. The stop may be an obstruction installable in tube 40*b* or a protrusion such as a collar 44 on bar 40*a*. Collar 44 has an outer diameter greater than the inner diameter of the tube and, therefore, collar 44 cannot move into the tube and stops against the tube's upper end 40*b*'. In one embodiment, there a rear link length adjustment mechanism such as a position selector for collar 44, through which the location of collar 44 along bar 40*a* can be selected to determine the position at which bar 40*a* can no longer telescope into tube 40*b*. This position selector is shown as a pin 46*a* and locator holes 46*b*, 46*c*. In this embodiment, pin 46*a* can be pinned through a hole 46*b* in collar 44 that is aligned with a hole 46*c* on bar 40*a* to select the position of the collar along the bar. While the illustrated embodiment includes both a series of holes 46*b* on collar 44 and a series of holes 46*c* on the bar, only one series of holes is needed.

Rear link 40 is pivotally connected to base frame 16. In the illustrated embodiment, the pivotal connection 48 of link 40 to the base frame is substantially coaxial with hinge 32. As such, the orientation between links 30, 40 and trough 12 is substantially triangular. While pivotal connections 48 need not be coaxial with hinge 32, the positioning of these pivot axes coaxially allows for a greater range of potential mast angles.

Cylinder 50 provides the drive to lift the trough to its raised position. The cylinder can be actuated to move the trough upwardly and forwardly on the links 30, 40 until the trough is supported above the base frame on the links.

In the illustrated embodiment, cylinder 50 is pivotally connected at one end to a clevis 52 on base frame 16 and is pivotally connected at its other end to a clevis 54 on main pivot link 30. Clevis 54 is close to pivot point 34.

In operation, the location of collar 44 on the rear link 40 is selected to predetermine the angle α relative to horizontal that the trough will be at when fully raised. This angle may be selected, for example, based on the slant angle of the mast. For example, the angle α may be selected to substantially match the slant angle of the mast, which is generally between 40° and 50°. If the collar is not already at the appropriate location to achieve the desired angle, it may be moved and re-secured before the trough is lifted. For example, collar 44 may be unpinned and slid to align the appropriate holes and the pin may be reinserted.

Pipes are stored on a pipe rack adjacent cat walk surface 16*d*. The rack may be sloped to urge the pipes to roll against index pin 16*e*. The index lifter bar 16*f* may be driven, as by use of a cylinder or other driver, to move up to lift one pipe over stop pin 16*e* and push the pipe toward the upper surface of trough 12.

Once the one pipe is in the trough, the clamp cylinders extend and the clamps 22 clamp onto the pipe, pushing it down into the trough. At this point, cylinder 50 can begin to be extended to deliver the trough and the pipe thereon to a position adjacent the rig floor and the mast.

As the cylinder 50 extends, the front end is lifted and rear end is initially pulled along remaining supported on rollers 20. When the rear end is being pulled along on the rollers, the rear, link is compressing, by telescoping into itself. At a certain point, according to the predetermined location of the collar, the rear link bottoms out and compresses no more. When the rear link bottoms out, the entire trough is raised off the base frame 16, including off of rollers 20, and is supported on links 30, 40. As cylinder 50 extends further, to the end of its stroke, the entire trough and links 30, 40 all rotate as one. When the cylinder finishes its stroke, the trough is now in the position where the pipe therein is adjacent the rig floor and is ready to be moved into the mast.

As noted herein before, cylinder 50 is (i) extendable to lift the trough and (ii) retractable to lower the trough. Any time that the trough is lifted out of contact with frame 16, it is supported on links 30, 40 with the cylinder providing the drive force. From the folded position (FIG. 1A), when cylinder 50 is extended, main pivot link 30 is pivoted up away from base frame 16 and the front end of trough 12 is moved forwardly and upwardly with main pivot link 30. As the front end of the trough is moved forwardly and upwardly on link 30, the rear or second end of the trough is first pulled along the base frame, for example along bed 18. Rollers 20 of the bed facilitate this sliding movement.

The rear link permits this sliding movement of trough 12 until the rear link bottoms out. In particular, rear link 40 collapses telescopically as the trough is pulled forward by cylinder 50. The telescoping compression of link 40 continues until it bottoms out, for example, until collar reaches upper end 40*b*' of the tube and link 40 can telescopically collapse no more. At that point, the rear portion of the trough begins to pivot and to be lifted off the rollers of base frame 16. The transition point, when rear link 40 bottoms out and the rear end of trough 12 moves between sliding and upward pivoting movement, is illustrated in FIG. 2A.

When link 40 bottoms out, the angle between trough 12 and link 30 is set and the trough is moved up with a fixed angle, which when the trough is erected defines slant angle α between trough 12 and horizontal. Angle α is adjustable mechanically by adjusting the position of collar 44 on bar 40*a*. While the illustrated apparatus 10 is adjustable to angles between 40-50°, a greater range of angles can be achieved by adding more holes 46*b* or 46*c*. Other embodiments are possible that are adjustable between vertical and 60° from vertical, which is 40° from horizontal.

The operation is reversed when laying down pipe or returning the trough for picking up a further pipe. It is noted that when the trough is brought down, the trough is supported on bed 18, specifically rollers 20, before cylinder 50 completes its retraction stroke. As such, apparatus 10 supports the rear end of the trough on rollers 20 as the cylinder reaches the end of its stroke, which is the phase of cylinder movement that is most likely to result in an uncontrolled drop.

It is noted that while the pipe handler describes links 30, 40 and cylinder 50 as singular structures, they may be installed in duplicates, such as is somewhat apparent in FIG. 3B. There may be a pair of links 30, a pair of links 40 and a pair of cylinders 50. The pairs may be connected, as by webs as shown between links 30 and 40, or otherwise synchronized such that each pair acts as a single structure.

Referring now to FIGS. 4A to 10B, a pipe loader 100 is employed to load pipes, one section 101 at a time, into well center in line with the mast 102 of a well operation rig 104. At well center, the pipe is stabbed into the stump of a pipe held in the rig floor ready for manipulation by wrench 106 and/or moved to be gripped and driven by a tool carrier 108 to be connected into the well string.

Generally, each pipe is handled up adjacent the rig floor by a pipe handler such as for example the one described herein before.

The pipe loader 100 also is employed in the reverse to remove pipes, one section at a time, from the well string and move them back onto the pipe handler.

Figure 4B:
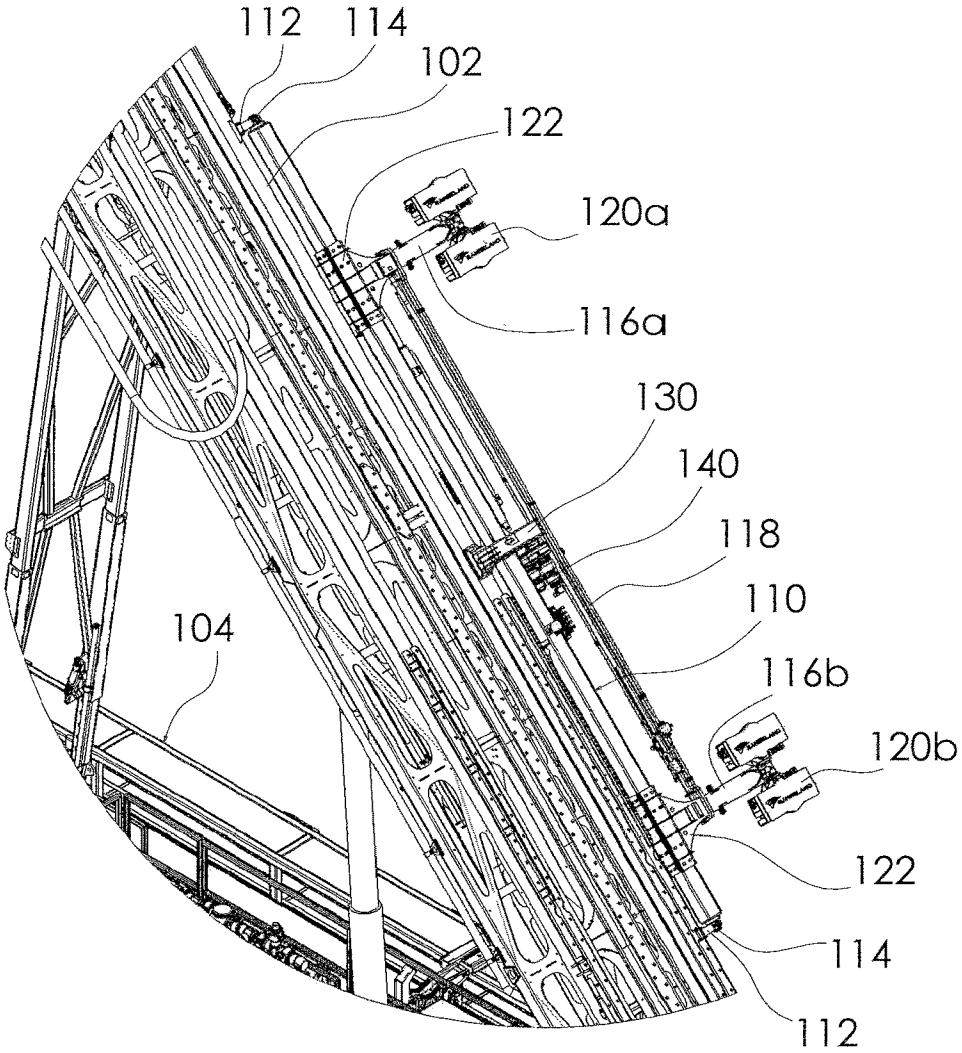
FIG. 4B is an enlargement of detail A of FIG. 4A.
Figure 4A:
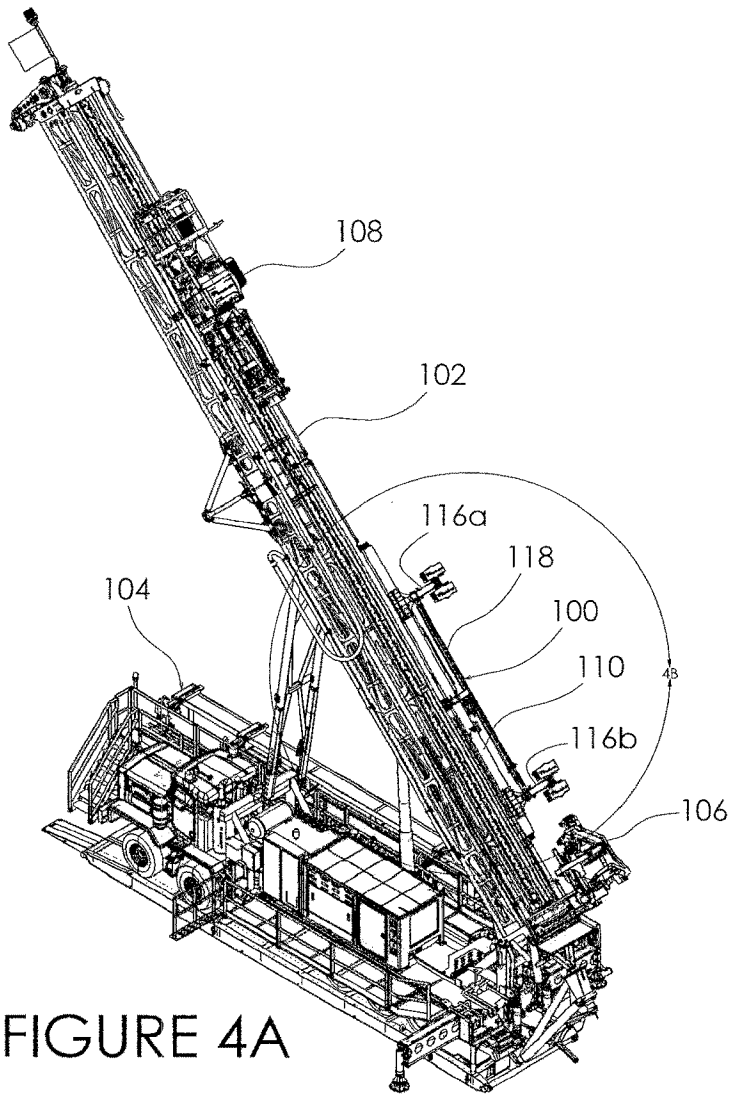
FIG. 4A is a top, rear perspective view of a rig showing a mast erected on a slant angle and a pipe loader on the mast.

Pipe loader 100 operates to load the pipes at an angle that corresponds with well center. In some cases, the rig 104 may be operating with its mast 102 on a slant, as shown in FIG. 4A. In such a case, pipe loader 100 can hold the pipe on a slant with an angle substantially the same as the mast's slant angle. The pipe loader may include a center structure, such as a support beam 110, defining a center axis and the center structure can be installed on the mast with the center axis x substantially parallel to the mast angle. The pipe loader may be secured to mast 102 and may include arms 116*a*, 116*b* spaced apart on the center structure that hold a pipe and move it into alignment with well center. The arms may be moveable in unison, with respect to rate, direction and angle, to rotate about the center structure to move from a pipe handler side to a well center-aligned side.

The arms may also be moveable in unison axially along the center structure in a direction parallel to the loader's center axis. As such, the arms can rotate around the center structure or move axially to translate up/down along the center structure. As such, the pipe loader may be used to stab the gripped pipe into the stump pipe on the rig floor or upwardly into a tool carrier on the rig mast.

The arms may each carry a pipe grabbing head 120 with jaws to hold a pipe therewithin. The jaws are configured to have a constant center regardless of gripping diameter of the jaws (i.e. regardless of the outer diameter of the pipe being handled). Knowing that the constant center is maintained facilitates alignment of the pipe grabbing head with the well center axis. The jaws on one arm may be substantially synchronized with the jaws on another arm to force the jaws to open and close in a substantially synchronized manner. The jaws on the grabber head are configured to hold a pipe such that it can be moved. In one embodiment, however, there may be hard clamp jaws that grip a pipe and/or soft clamp jaws that hold a pipe but allow rotation and axial movement of the pipe while being held by the jaws.

Each pipe grabbing head may be configured to swivel from one side of the arm on which its attached to the other such that the pipe grabbing head may be oriented to grip or release a pipe with the jaws facing down.

In the illustrated embodiment, pipe loader 100 comprises: a support beam 110 as the center structure. The support beam defines a center axis x of the pipe loader. Beam is the main support structure of the loader and imparts torque to the loader and, so, sometimes may be referred to as the torque tube. Beam 110 may be a tube and may be faceted, such as having a square-shaped, cross section.

Beam 110 includes brackets 112 through which the loader is mounted to rig mast 102 for use. The brackets secure the beam in parallel with the long axis of the mast 102. As such, if the mast is slanted, the beam will have the same slant angle as the mast. The brackets may be limited to the ends of the beam such that the middle section of the beam is free of bracket supports. Bearings 114, such as for example, spherical roller bearings are installed between the beam and brackets 112 to permit rotation, arrow R, of the beam about axis x relative to the brackets 112.

A first arm 116*a* and a second arm 116*b* extend from the support beam. The second arm is spaced from and substantially parallel to the first arm. The arms are intended to work in substantial unison and may include a synchronizing link 118 that is secured between them. A pipe grabbing head 120*a*, 120*b* is installed on the terminal end of each of the first arm and the second arm. The pipe grabbing heads each include pipe holding jaws 121*a*', 121*a*", 121*b*', 121*b*".

The arms 116*a*, 116*b* and pipe grabbing heads 120*a*, 120*b* are configured to hold a pipe substantially parallel to beam 110. The two arms are structurally similar, as are the grabbing heads.

To facilitate understanding, the following description of the arms and the pipe grabbing heads may focus on operation of a single arm 116, its pipe grabbing head 120 and jaw 121',121".

Each arm is secured to beam 110 via a collar 122 that ensures that the arm rotates with the beam, but can slide axially along the beam. The rotational connection between the collar and its arm is rigid such that any movement of the collar is transferred to the arm. Collar 122 may be faceted in a manner identical to the faceting of the beam such that when the beam is rotated about axis x, the collar and its arm also rotate about axis x. For example, collar 122 may have an inner diameter that is square in cross section similar to the cross section of the beam. Collar 122 may have an inner bearing liner, such as may include one or more wear pads 123. In one embodiment, collar 122 may be removable from the beam for adjustment of wear pads. In the illustrated embodiment, for example, the collar includes two lengthwise halves connected by removable fasteners 124 and removable shims 126 are provided between the halves. Shims 126 may be removed after there is reduction of wear pads 123. Removal of the shims 126 reduces the inner diameter of the collar and extends the useful life of wear pads 123, allowing them to be used for a longer period of time. When new wear pads are installed, the shims 126 can be reintroduced to expand the inner diameter and to again offer a staged wear process of pads 123.

Figure 5A:
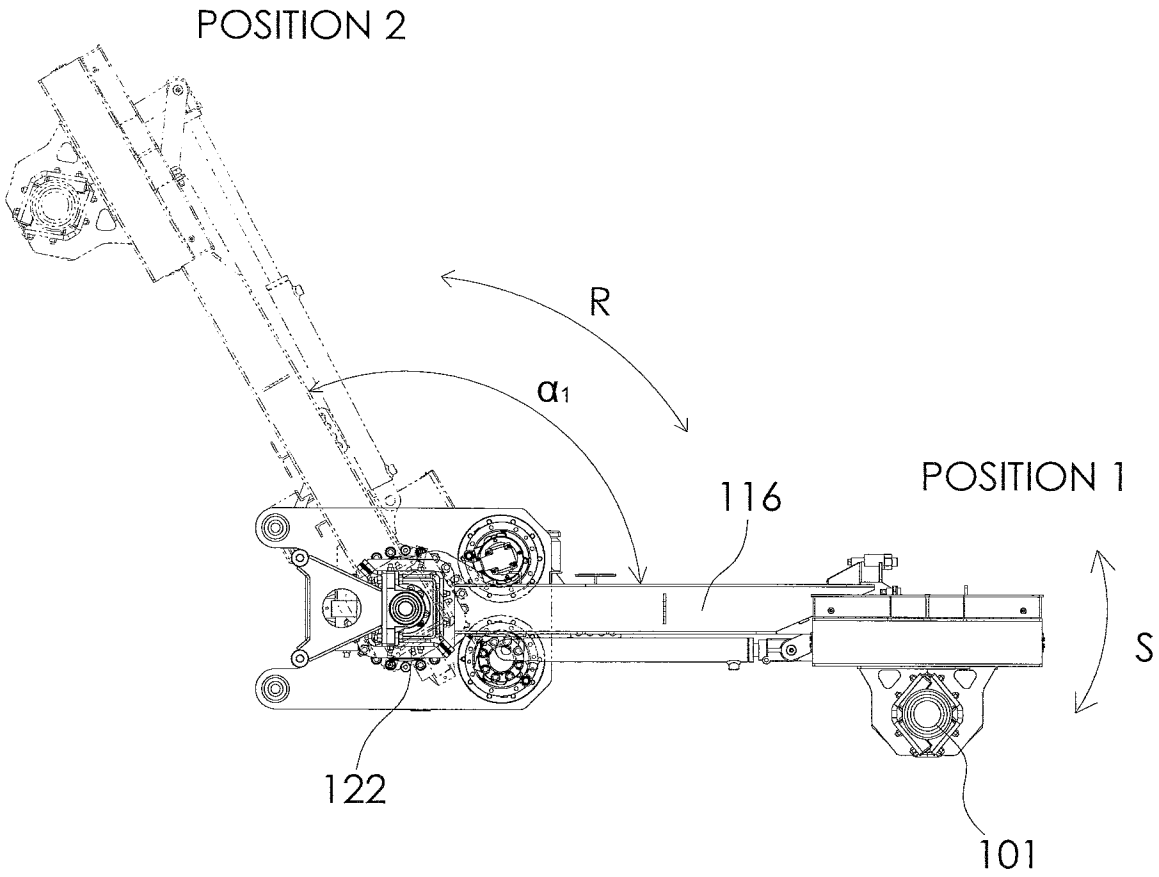
FIGS. 5A and 5B are end and top, end perspective views, respectively, of a pipe loader showing two possible positions.
Figure 5B:
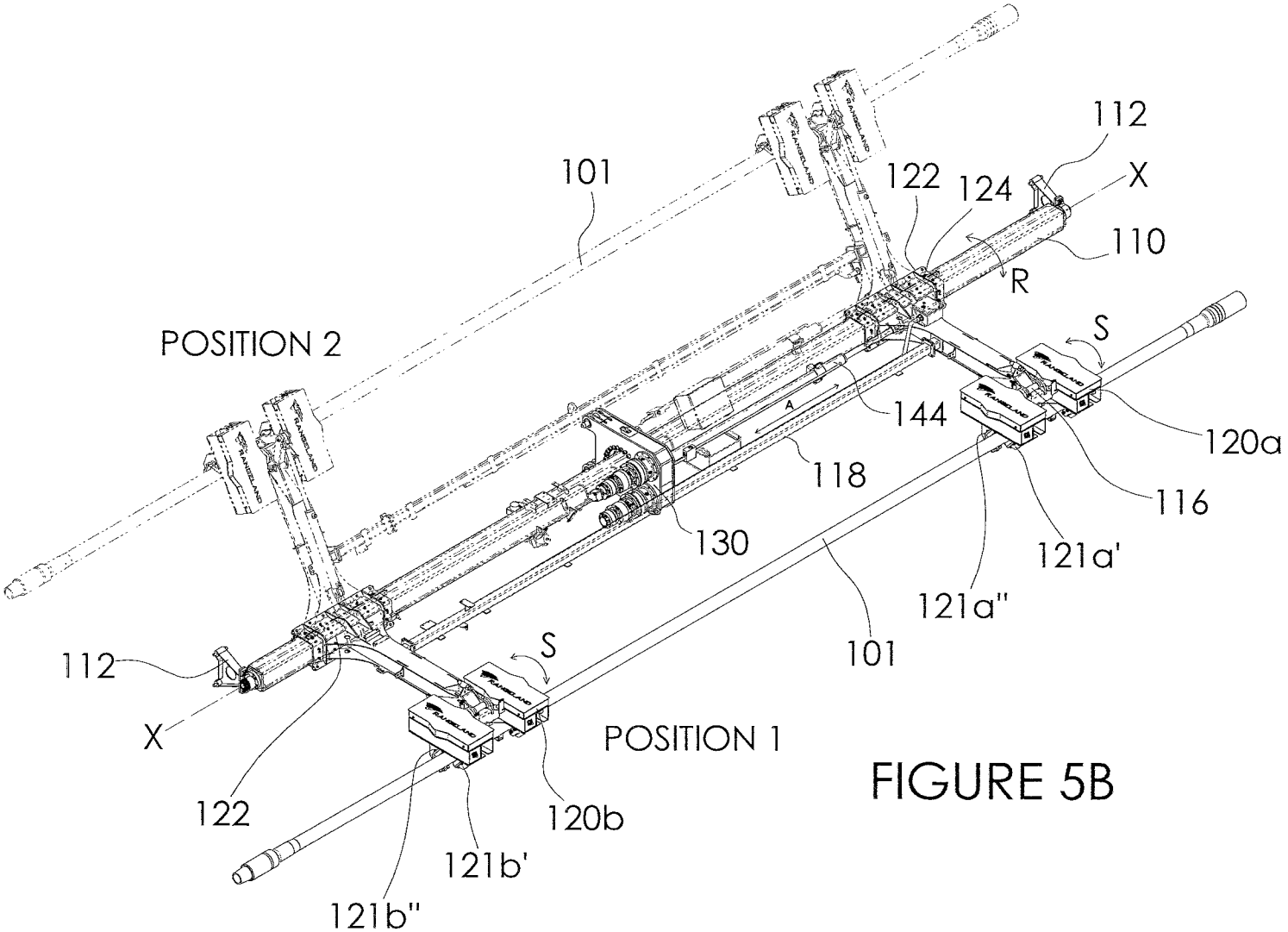
Figure 6:
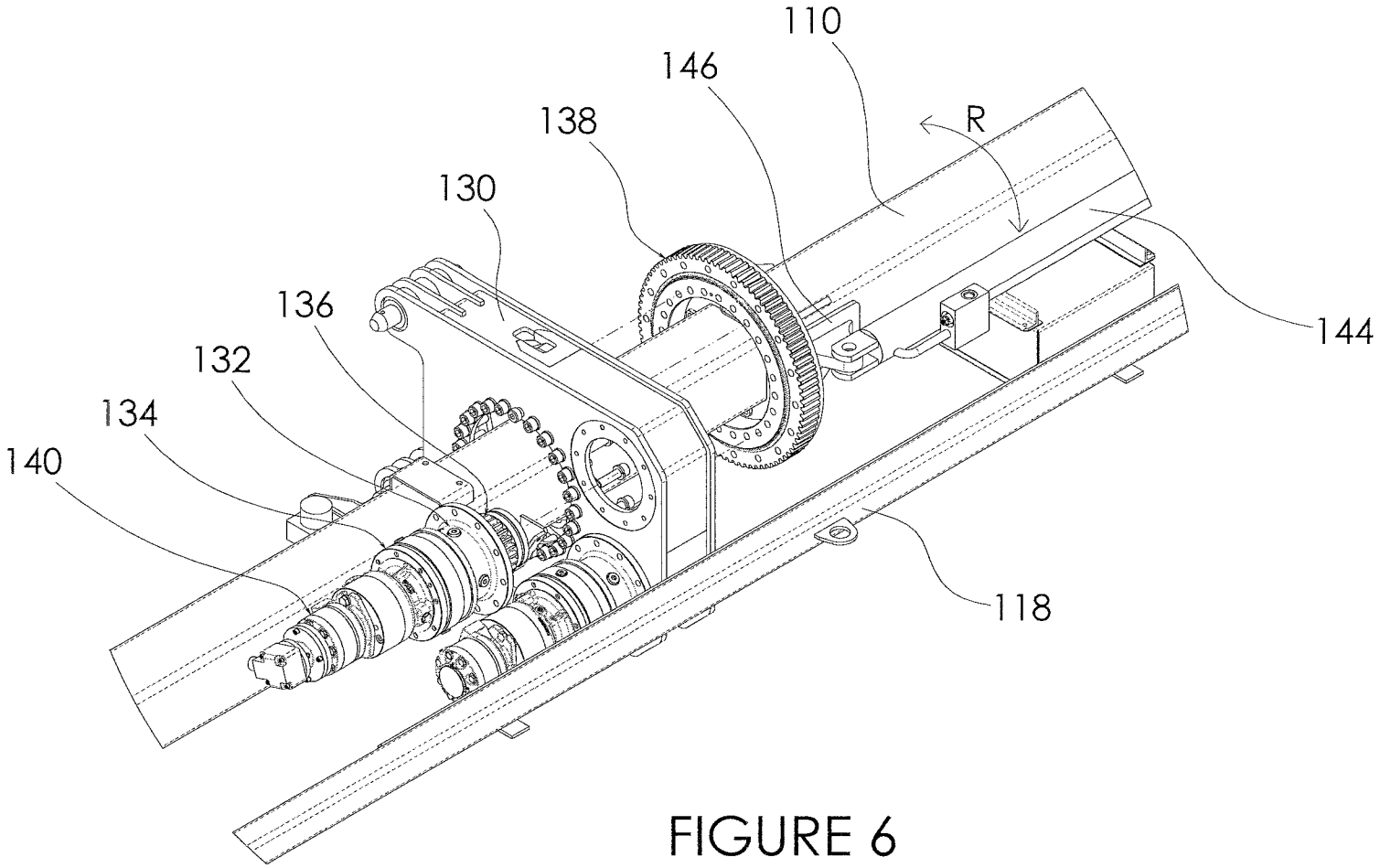
FIG. 6 is an enlarged, exploded view of a driver for a pipe loader.

A driver drives the first arm and the second arm in substantial unison, about the axis x. As shown in FIGS. 5A and 5B, the driver can drive the beam to thereby drive the arms to rotate, arrow R, around a slew angle $\alpha 1$. One possible driver is illustrated in partial exploded condition in FIG. 6. The illustrated driver includes a housing 130 connectable to the rig mast and a gear assembly 132 that engages the beam. The gear assembly may include a gear box 134 that drives a pinion gear 136 anchored in the housing. The gear assembly may further include a bearing such as a slew bearing 138 on the beam that is meshed with and driven by pinion gear 136. The driver may be powered by various means but herein is illustrated with a hydraulic motor 140. The hydraulic motor drives the gear box.

The driver can rotate beam 110 and thereby arms 116*a*, 116*b* about any slew angle. Generally, the rotation is between a first position where pipe is picked up or off-loaded, for example, adjacent the elevated pipe handler (Position 1) and a second position with the pipe grabbing heads aligned along well center (Position 2 shown in phantom). The gear assembly may include adjustable stops, for example, on the slew bearing to select the range of motion.

Because the driver drives rotation of the beam that is communicated through the collars to the arms, the arms move in unison and only one driver is required. The driver may be positioned on the beam in between the two collars so that the relative defection under load between the two arms is similar.

In one embodiment, the loader further includes a translational linear actuator for driving movement, arrow A, of the arms along axis x. This moves arms up and down along the mast, as may be useful for moving a pipe held by the arms up or down along the mast. This is the motion useful for stabbing a pipe up into the tool carrier or down into a pipe stump held in the rig floor, for example near the torque wrench. In the illustrated embodiment, a cylinder 144 acts as the translational linear actuator and is connected at one end to a mount site 146 on beam 110 adjacent driver housing 130 and the cylinder is connected at the other end to one of the collars 122. Because rod 118 connects the collars 122 of the two arms, the cylinder need be connected to only one of the collars. Extension or retraction of cylinder 144 drives the collar that is attached to the cylinder and thereby drives the arms to translate axially along the beam 110.

Figure 7B:
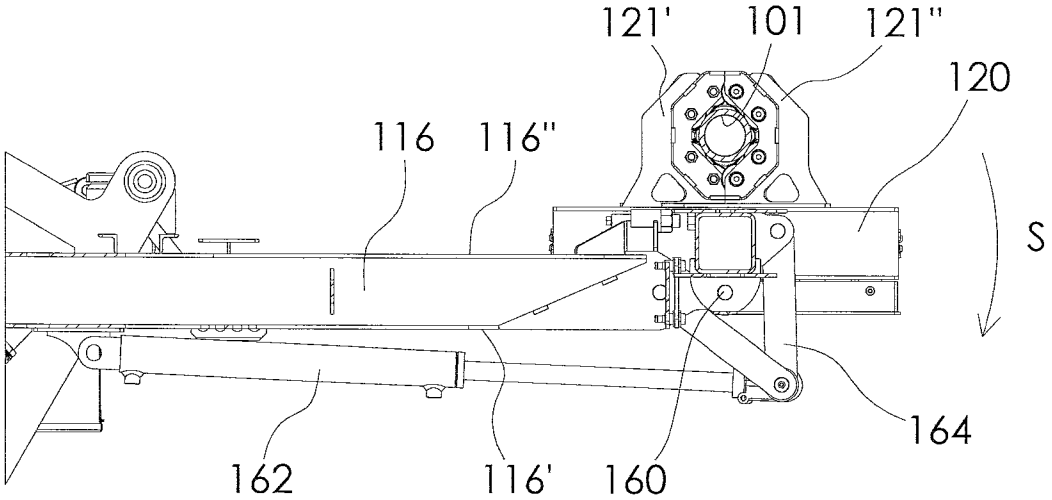
FIGS. 7A and 7B are end views of an arm with a pipe grabbing head in two positions.
Figure 7A:
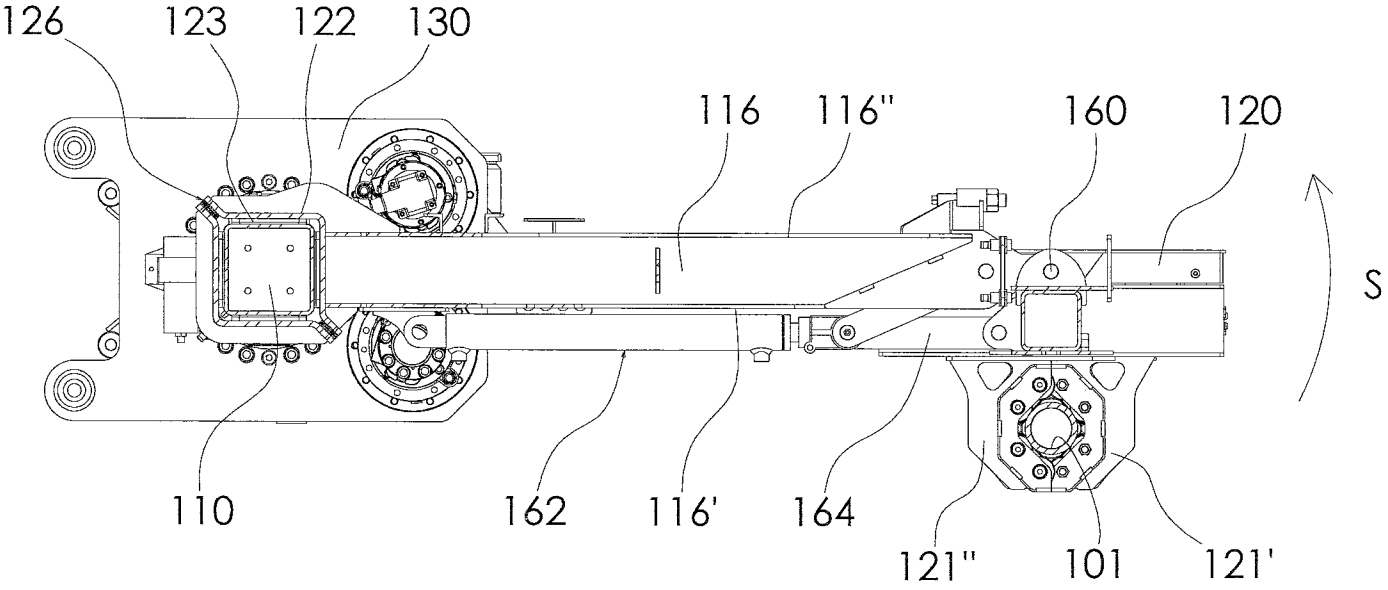

When the loader moves into and out of Positions 1 and 2, it manipulates pipe 101. Generally, the range of motion will be about 180 degrees, through an arc over the top of beam 110. For example, when moving into Position 1 to pick up a pipe, arm 116 and pipe grabbing head 120 come down from above, engage the pipe and lift the pipe up and away from Position 1. The best position to grab a pipe and release a pipe is from above, as the arms and head can reach in without being obstructed by the mast, the pipe supply area (i.e. such as trough 12 of pipe handler 10, FIG. 3B) and by the pipe to be grabbed. In the illustrated embodiment, the pipe grabbing head 120 is configured to swivel on its arm 116 such that the jaws 121',121" on the head, both in Position 1 and in Position 2, can be oriented always to open facing down (with reference to gravity). For example, the jaws may be swiveled from facing in one direction relative to its arm to facing in the other opposite direction on an opposite side of the arm, rotated through about 180°. The swiveling action may be in plane, for example in a plane orthogonal to the center axis x. Thus, in one embodiment (FIGS. 7A and 7B), there is a pivoting mechanism including a pivot point 160 between arm 116 and its pipe grabbing head 120. The pivot mechanism may move, arrow S, the pipe grabbing head between a first orientation (FIG. 7A) with the backside of the head lying against one side 116' of the arm to a second orientation (FIG. 7B) with the back of the head 120 lying against the other, opposite side 116" of the arm. While FIGS. 7A and 7B show the arm not having moved, generally the purpose of the pivot mechanism is that both in Position 1 and Position 2 of the arms, the jaws can always be facing down. Thus, while the arm in FIG. 7A may represent the arm in Position 1 and with head in the first orientation, when the head is in the second orientation of FIG. 7B, the arm may have been swung over to the opposite side (Position 2). Thus, head may be pivoted such that jaws 121',121" are always on the underside of the grabbing head (i.e. facing down) when the arms are in their stopped positions (Position 1 and Position 2) at opposite ends of the slew angle R.

The pivot mechanism may include, for example, a pivot cylinder 162 and a pivot linkage 164 that swivels the pipe grabbing head 120 around its pivot point connection 160 to the arm 116. Retracting cylinder 162 drives and maintains head 120, through linkage 164, to have its backside positioned against side 116' of the arm. When cylinder 162 is extended, this force is transferred through pivot linkage 164 to drive head 120 around its pivot point 160, arrow S, to have its backside positioned and maintained against side 116" of the arm.

The pivot mechanisms on the two pipe grabbing heads 120*a*, 120*b* may be synchronized such that the two pipe grabbing heads move between the orientations of FIGS. 7A and 7B in substantial unison.

FIGS. 8 to 10B illustrate a pipe grabber head 120 with a jaw configuration useful in the present pipe loader. Head 120 includes two pairs of jaws 121',121" and 123',123".

Each jaw in the pair of jaws is configured to hold a pipe with its inner facing surface. The inner facing surface of each jaw is concave and the jaws in a pair of jaws are oriented with the concave surface facing inwardly to its pair. In the illustrated embodiment, there are actually two types of jaws on head 120. One of the pairs of pipe gripping jaws 121',121" is configured such that each jaw in the pair includes hard clamps 170 on its inner facing surface such as with teeth 171 that grip the pipe and allow no relative of the movement of the pipe in the jaws when the jaws are closed around the pipe. The other pair of pipe gripping jaws 123',123" is configured with soft clamps 172, such as with rollers 174, that allow rotational and axial movement of the pipe within the jaws, when the jaws are closed around the pipe.

The hard clamps and soft clamps are independently movable, such that one pair or both pairs can be activated to secure around the pipe. If the operation of the soft clamps to permit rotational or axial movement of the pipe through the jaws, while still gripped, only the soft clamps are actuated to move and close on a pipe.

Neither clamp type, when clamped, allows lateral or radial movement of the pipe relative to the head, but instead holds the pipe with the pipe's long axis centered on a center point C between the jaws. As can be appreciated from FIGS. 9A and 10A, jaws 123',123" are configured to always clamp relative to the same center point C regardless of the diameter of the pipe. For example, notice how the jaws 123',123" shown in phantom in FIG. 9A have the same center point C as the jaws 123',123" shown in solid lines in FIG. 9A and the jaws shown in FIG. 10A, all jaws of which are arranged at different gripping diameters.

In the illustrated embodiment, for example, the jaws are configured to translate along a linear path of motion, arrow L, as they move towards and away from each other, rather than pivoting relative to each other. Thus, the pipe holding jaws may include a translating mechanism holding the first jaw and the second jaw. The translating mechanism is configured to permit the first jaw and the second jaw (i) to move linearly in a first direction towards each other into a pipe gripping position (FIG. 9A phantom lines) and (ii) to move linearly apart in a reverse direction from the first direction into a pipe releasing position (FIG. 9A solid lines).

Figure 8:
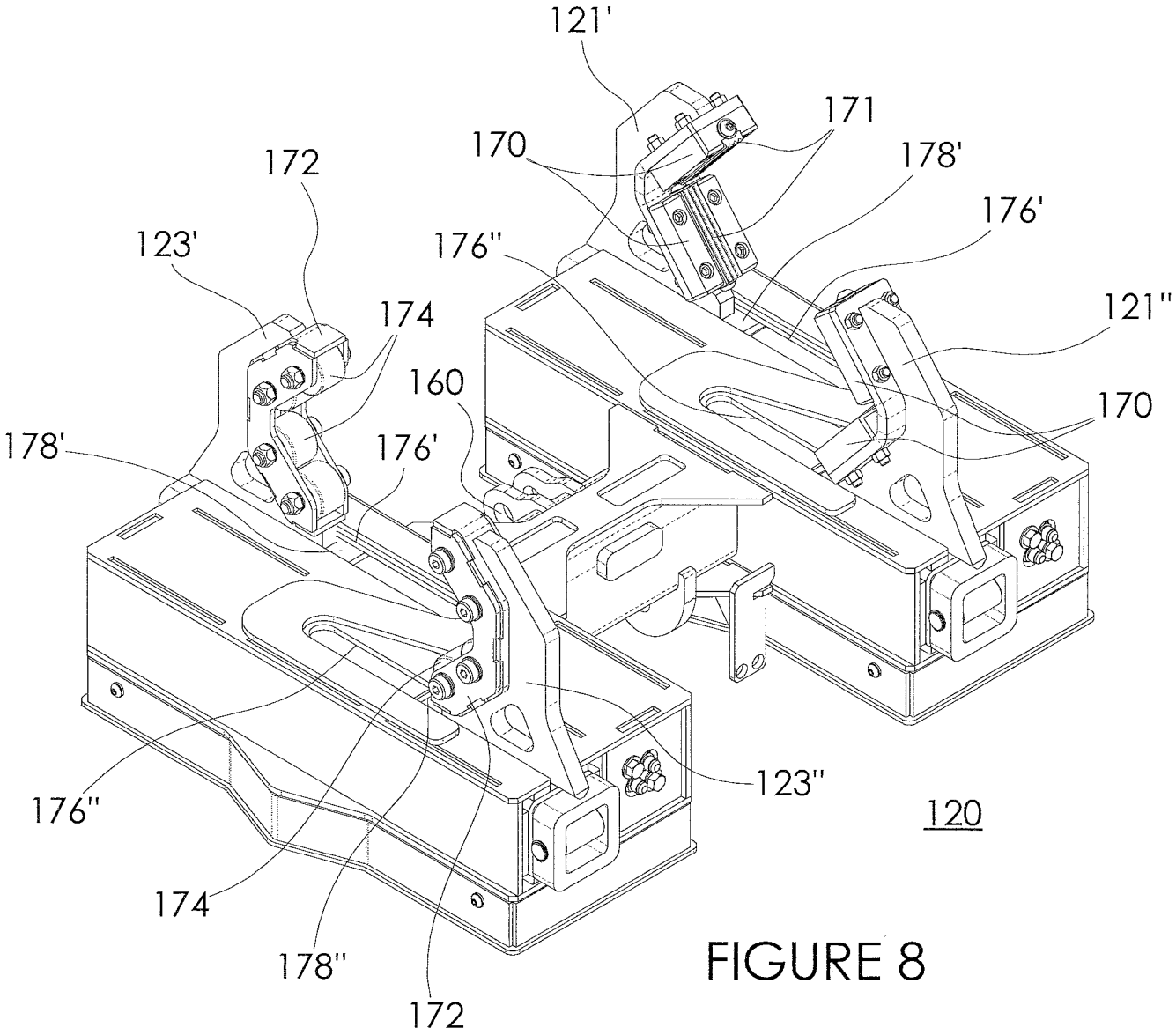
FIG. 8 is a top, end perspective view of a pipe grabbing head showing a front side with jaws.

In one embodiment, the translating mechanism includes a sliding track for the jaws. As illustrated in FIG. 8, jaws 123',123" in each pair are mounted on adjacent, parallel tracks 176',176" and the jaws slide towards and away from each other on the tracks. The jaws are mounted on shuttles 178',178" that are constrained to move linearly in their respective tracks. In the illustrated embodiment, each track is within a housing of the grabber head and each jaw connects through a slot in the housing to its shuttle in the track.

The jaws in each pair may be driven along the tracks by two opposing linear actuators, such as cylinders 182. Alternately, as shown, drive may be provided to a pair of jaws through a single linear actuator linked to both shuttles of the pair. Only one cylinder is shown in the drawings, that being in FIG. 10B. That cylinder 182 is for the jaw 123'. In one embodiment, the jaws are closed by applying a linear push force from cylinder 182 to the shuttle 178' and the jaws are opened by applying a linear pull force from the cylinder to the shuttle.

In addition, the jaws in each pair are configured for synchronous movement, as by connection through a synchronizing linkage 184 and/or a hydraulic flow divider that forces the jaws in each pair to move at the same rate and always have a gripping diameter centered on the same center point C. With a hydraulic flow divider, the opposing cylinders may have the same hydraulic source. In one embodiment, the matching jaws on the two grabbing heads 120*a*, 120*b* (i.e. the soft clamps on the two heads) may also have the same hydraulic source such that their movement is also substantially synchronized.

The previous description of the disclosed embodiments is provided to enable any person skilled in the art to make or use the present invention. Various modifications to those embodiments will be readily apparent to those skilled in the art, and the generic principles defined herein may be applied to other embodiments without departing from the spirit or scope of the invention. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are known or later come to be known to those of ordinary skill in the art are intended to be encompassed by the elements of the claims. Moreover, nothing disclosed herein is intended to be dedicated to the public regardless of whether such disclosure is explicitly recited in the claims. No claim element is to be construed under the provisions of 35 USC 112, sixth paragraph, unless the element is expressly recited using the phrase "means for" or "step for".

What is claimed is:

1. A pipe handling machine for manipulating joints of pipe at a rig site, the pipe handling machine comprising:

a base frame;

a trough configured to accommodate a pipe to be handled, the trough having a first end and a second end;

a main pivot link pivotally connected between a hinge on the base frame and a pivot point adjacent the first end of the trough;

a rear link pivotally connected between a first pivotal connection, where the rear link is connected to the base frame, and a second pivotal connection on the trough, the first pivotal connection having an axis of rotation that is coaxial with the hinge and the second pivotal connection being spaced from the first end and positioned at an intermediate position between the first end and the second end or at the second end such that an orientation between the trough, the main pivot link and the rear link is triangular;

and a linear actuator for driving the trough upwardly to be supported above the base frame on the main pivot link and the rear link, the rear link having a length longer than the main pivot link such that when the trough is supported above the base frame on the main pivot link and the rear link, the trough is sloped with the first end lower than the second end.

2. The pipe handling machine of claim 1 wherein the rear link is compressible from a longer length to the length and the rear link is configured to compress from the longer length to the length prior to being driven upwardly by the linear actuator.

3. The pipe handling machine of claim 2 wherein the rear link is telescopically formed to be compressible.

4. The pipe handling machine of claim 2 further comprising rollers between the trough and the base frame, the rollers configured to accommodate sliding movement of the trough along the base frame while the rear link compresses from the longer length to the length.

5. The pipe handling machine of claim 1 wherein the rear link includes a compression bar telescopically slidable within a tube, a stop for limiting the degree to which the compression bar slides within the tube and a length adjustment mechanism configured for selectably varying and setting the location of the stop.

6. The pipe handling machine of claim 1, further comprising a support area on the base frame and configured to support sliding movement of the trough along the base frame and the support area being positioned to support the trough when the linear actuator is near a minimum length.

7. The pipe handling machine of claim 6, further comprising rollers configured to facilitate sliding movement of the trough along the base frame at the support area.

8. A method for manipulating a joint of pipe from a horizontal pipe rack to a rig mast of a rig, the rig mast being oriented at an angle corresponding to a well center angle, the method comprising:

positioning a pipe handling machine adjacent to the rig, the pipe handling machine including: a base frame; a trough configured to accommodate the pipe to be handled, the trough having a first end and a second end; a main pivot link pivotally connected between a hinge on the base frame and a pivot point adjacent the first end of the trough; a rear link pivotally connected between a first pivotal connection, where the rear link is connected to the base frame, and a second pivotal connection on the trough, the first pivotal connection having an axis of rotation that is coaxial with the hinge and the second pivotal connection being spaced from the first end and positioned at an intermediate position between the first end and the second end or at the second end such that an orientation between the trough, the main pivot link and the rear link is triangular; and a linear actuator for driving the trough upwardly to be supported above the base frame on the main pivot link and the rear link, the rear link having a length longer than the main pivot link; and driving the linear actuator to drive the main pivot link and the rear link about the axis of rotation to thereby move the trough upwardly to be supported above the base frame on the main pivot link and the rear link with the trough oriented with the first end lower than the second end.

9. The method of claim 8 wherein the rig mast is oriented at a slant angle and driving the linear actuator orients the trough at a slant angled substantially parallel to the slant angle.

10. The method of claim 9 further comprising changing the length of the rear link to adjust the degree to which the trough is oriented on the slant.

11. The method of claim 8 wherein driving the linear actuator includes in a first phase pivoting the main pivot link up away from the base and pulling the second end of the trough along on the base frame while the rear link compresses in length; and in a second phase, bottoming out at a compressed length of the rear link and pivoting the rear link up away from the base frame, until the trough is supported spaced above the base frame on the main pivot link and the rear link with the trough oriented with the first end lower than the second end.

12. The method of claim 8 further comprising, after driving the linear actuator, retracting the linear actuator to lower the trough toward the base frame; resting the second end of the trough on the base frame; and pushing the second end along the base frame while the linear actuator continues to retract and until the main pivot link has pivoted down to position the first end of the trough in a supported position on the base frame.

* * * * *